US010107479B1

(12) United States Patent
Carroll

(10) Patent No.: US 10,107,479 B1
(45) Date of Patent: Oct. 23, 2018

(54) INTERCHANGEABLE LAMP SHADE FOR A LIGHTING FIXTURE AND METHOD OF ASSEMBLY

(71) Applicant: Carroll by Design, LLC, Brentwood, TN (US)

(72) Inventor: David Carroll, Brentwood, TN (US)

(73) Assignee: Carroll By Design, LLC, Brentwood, TN (US)

( * ) Notice: Subject to any disclaimer, the term of this patent is extended or adjusted under 35 U.S.C. 154(b) by 0 days.

(21) Appl. No.: 15/484,870

(22) Filed: Apr. 11, 2017

(51) Int. Cl.

| | |
|---|---|
| ***F21V 11/00*** | (2015.01) |
| ***F21V 17/00*** | (2006.01) |
| ***F21V 1/04*** | (2006.01) |
| ***F21V 1/14*** | (2006.01) |

(52) U.S. Cl.
CPC ..... *F21V 17/002* (2013.01); *F21V 1/04* (2013.01); *F21V 1/143* (2013.01)

(58) Field of Classification Search
CPC ..... F21V 17/002; F21V 1/143; F21V 1/04
See application file for complete search history.

(56) References Cited

U.S. PATENT DOCUMENTS

| | | | | |
|---|---|---|---|---|
| 2,111,844 | A | 3/1938 | Davidson | |
| 4,075,684 | A | 2/1978 | Witz | |
| 4,212,052 | A | 7/1980 | Chambard | |
| 4,275,434 | A | 6/1981 | Borowitz | |
| 4,354,222 | A | 10/1982 | Gall | |
| 5,211,474 | A | 5/1993 | Leitner et al. | |
| 5,532,912 | A | 7/1996 | Bendit | |
| 5,571,280 | A | 11/1996 | Lehrer | |
| 5,662,412 | A | 9/1997 | Glendmyer | |
| 6,079,855 | A | 6/2000 | Azeredo et al. | |
| 6,494,598 | B2 | 12/2002 | Yeh | |
| 8,596,833 | B1 | 12/2013 | Cytrynowicz | |
| 9,121,572 | B2 * | 9/2015 | Lewis | F21V 1/02 |
| 9,546,770 | B2 * | 1/2017 | Wu | F21V 1/04 |
| 2005/0231960 | A1 * | 10/2005 | Li | F21V 1/06 362/352 |
| 2009/0225553 | A1 | 9/2009 | Wu | |
| 2012/0287650 | A1 | 11/2012 | Anderson et al. | |
| 2012/0320605 | A1 | 12/2012 | Wu | |
| 2013/0201695 | A1 | 8/2013 | Lewis et al. | |

FOREIGN PATENT DOCUMENTS

| | | | |
|---|---|---|---|
| KR | 1020140000027 | A | 1/2014 |

OTHER PUBLICATIONS

PCT Search Report and Written Opinion for PCT/US2018/027163 dated Jul. 27, 2018, 17 pages.

* cited by examiner

*Primary Examiner* — Evan Dzierzynski
(74) *Attorney, Agent, or Firm* — Waller Lansden Dortch & Davis LLP; Matthew C. Cox

(57) ABSTRACT

An interchangeable lamp shade including an upper rigid frame. An interchangeable cover can be disposed on the upper rigid frame, the interchangeable cover having a sidewall and an upper end having an upper perimeter. An upper resilient band can be positioned on the cover and can extend along the upper perimeter of the cover. The upper rigid frame can be positioned between the upper resilient band and the sidewall of the cover, the upper resilient band resistant to twisting away from the upper rigid frame to retain the upper rigid frame between the upper resilient band and the sidewall of the cover. A method of assembling an interchangeable lamp shade of the present disclosure.

13 Claims, 13 Drawing Sheets

INTERCHANGEABLE LAMP SHADE FOR A LIGHTING FIXTURE AND METHOD OF ASSEMBLY

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present disclosure relates generally to lamp shades.

More particularly, the present disclosure relates to an interchangeable lamp shade for lighting fixtures. In conventional lighting fixtures such as lamps used to illuminate residential or commercial buildings, a lamp shade can include a frame and a cover extending over the frame. The frame of the lamp shade can be mechanically fastened to a lighting assembly including a light source with suitable fasteners such as bolts, screws, nuts, screw caps, etc. The cover on the lamp shade can at least partially block an observer's direct view of the light source on the lighting assembly.

In conventional lighting fixtures, the cover of the lamp shade is fixedly secured to the frame of the lamp shade. In order to change a lamp shade cover to achieve a different aesthetic appearance or lighting characteristic, the entire lamp shade must be replaced. Replacing the lamp shade involves removing the mechanical fasteners securing the lamp shade to the lighting assembly, removing the entire lamp shade from the lighting assembly, and securing an entirely new lamp shade to the lighting assembly with the mechanical fasteners. Switching out conventional lamp shades in such a manner can be time consuming and cumbersome, which is generally undesirable.

What is needed then are improvements to lamp shades such that lamp shade covers can be more readily interchanged.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is a lamp shade including an upper rigid frame. An interchangeable cover can be disposed on the upper rigid frame, the interchangeable cover having a sidewall and an upper end having an upper perimeter. An upper resilient band can be positioned on the cover and can extend along the upper perimeter of the cover, the upper rigid frame positioned between the upper resilient band and the sidewall of the cover, the upper resilient band resistant to twisting away from the upper rigid frame to retain the upper rigid frame between the upper resilient band and the sidewall of the cover. When the interchangeable cover is disposed on the upper rigid frame, the upper resilient band can retain the interchangeable cover on the upper rigid frame and prevent the interchangeable cover from slipping off of the upper rigid frame.

Another aspect of the present disclosure is a lamp shade including an upper rigid frame and a lower rigid frame. A collapsible, interchangeable cover can extend between the upper rigid frame and the lower rigid frame. The cover can include a sidewall, an upper end having an upper perimeter, a lower end having a lower perimeter, an upper resilient band extending along the upper perimeter of the cover, and a lower resilient band extending along the lower perimeter of the cover. The upper rigid frame can be positioned between the upper resilient band and the sidewall of the cover, and the lower rigid frame can be positioned between the lower resilient band and the sidewall of the cover. The upper and lower resilient bands can be resistant to twisting away from the upper and lower rigid frames respectively to retain the upper and lower rigid frames within the cover, or in a position between the cover and the upper and lower resilient bands respectively.

Another aspect of the present disclosure is a method of assembling a lamp shade including the steps of providing a cover having a sidewall, an upper end having an upper perimeter, and an upper resilient band extending along the upper perimeter of the cover; positioning an upper rigid frame at the upper end of the cover; and removably folding the cover over the upper rigid frame such that the upper rigid frame is positioned between the upper resilient band and the sidewall of the cover, the upper resilient band resistant to twisting away from the upper rigid frame to retain the upper rigid frame between the upper resilient band and the cover.

One objective of the present disclosure is to provide an interchangeable cover for a lamp shade of a lighting fixture.

Another objective is to provide an interchangeable cover for a lamp shade that can be quickly and conveniently removed and replaced on a frame of a lamp shade.

Another objective of the present disclosure is to help reduce the need to remove a frame of a lamp shade from a lighting fixture to change lamp shade covers on a lighting fixture.

Numerous other objects, advantages and features of the present disclosure will be readily apparent to those of skill in the art upon a review of the following drawings and description of a preferred embodiment.

DETAILED DESCRIPTION

Figure 1:
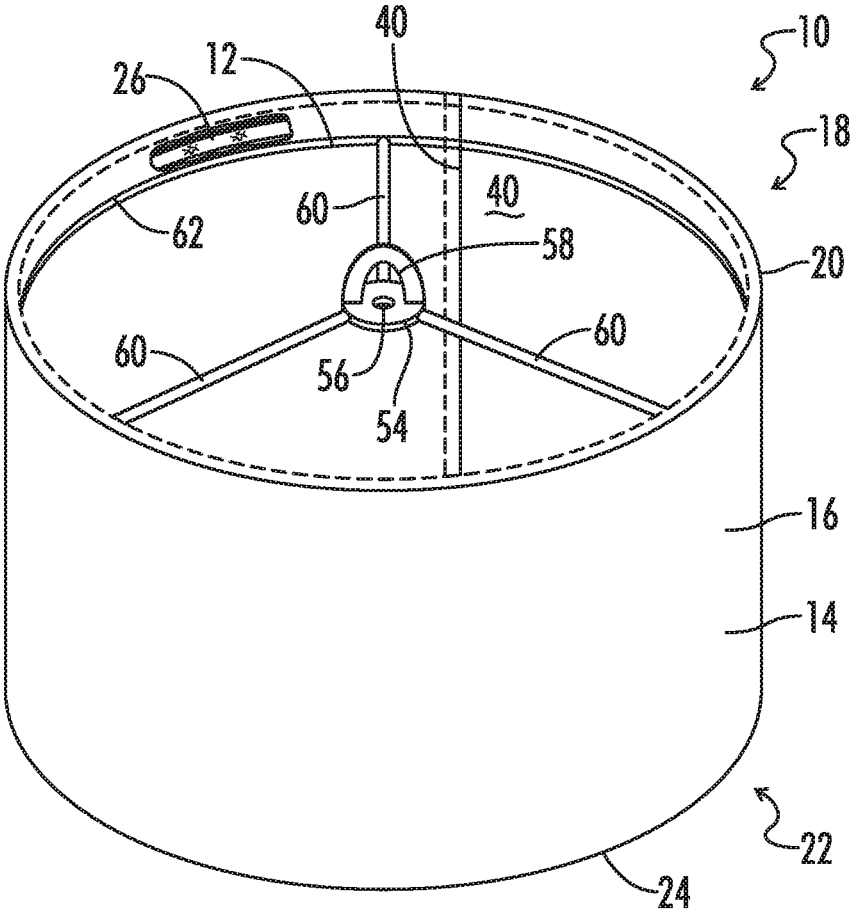
FIG. 1 is a perspective view of a fully assembled embodiment of a lamp shade of the present disclosure.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing, or as otherwise described. A person of skill in the art will recognize that the apparatus can assume different orientations when in use.

Figure 2:
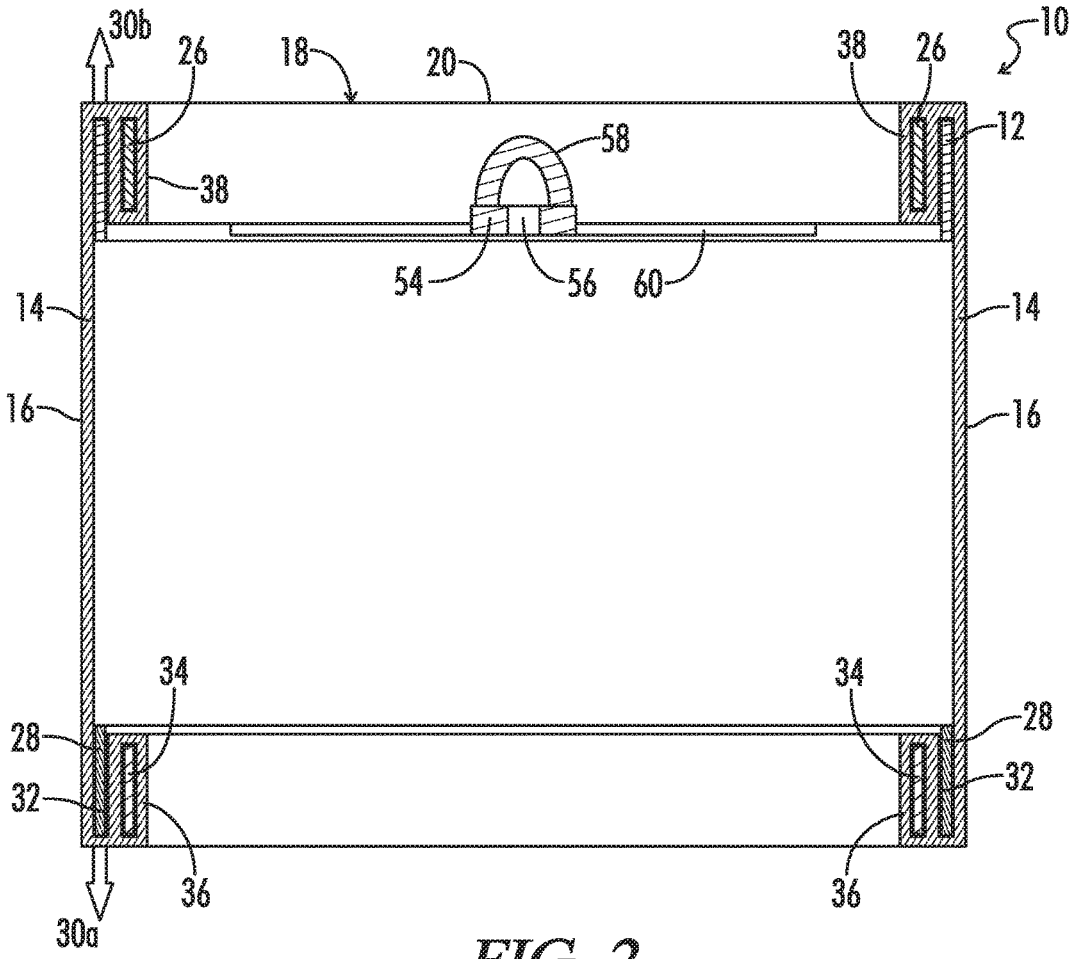
FIG. 2 is a cross sectional view of the lamp shade of FIG. 1.

An embodiment of a lamp shade 10 of the present disclosure is shown in FIGS. 1-2. Lamp shade 10 can include an upper rigid frame 12. Upper rigid frame 12 can be made from any suitable rigid material such as iron, steel, wood, etc. An interchangeable cover 14 can be disposed on upper rigid frame 12. Interchangeable cover 14 can have a sidewall 16, an upper end 18 having an upper perimeter 20, and a lower end 22 having a lower perimeter 24. An upper resilient band 26 can be positioned on cover 14 and can extend along upper perimeter 20 of cover 14. Upper rigid frame 12 can be positioned between upper resilient band 26 and sidewall 16 of cover 14. Upper resilient band 26 can be resistant to twisting in a direction away from upper rigid frame 12 to retain upper rigid frame 12 between upper resilient band 26 and sidewall 16 of cover 14.

In some embodiments, lamp shade 10 can include a weight member 28 supported at lower end 22 of cover 14. Weight member 28 can provide tension to sidewall 16 of cover 14 when cover 14 is disposed on upper rigid frame 12 and upper rigid frame 12 is suspended from a lighting assembly or fixture. Weight member 28 can produce a downward force 30*a* on cover 14 which can cause upper rigid frame 12 to produce an upward force 30*b* on cover 14 to tension sidewall 16 of cover 14 between upper rigid frame 12 and weight member 28, such that cover 14 can remain taut while lamp shade 10 is in use.

In some embodiments, weight member 28 can be a lower rigid frame 32 positioned at lower end 22 of cover 14. Lamp shade 10 can include a lower resilient band 34 positioned on lower end 22 of cover 14 and extending along lower perimeter 24 of cover 14. Lower rigid frame 32 can be positioned between lower resilient band 34 and sidewall 16 of cover 14. Lower resilient band 34 can be resistant to twisting in a direction away from lower rigid frame 32 to retain lower rigid frame 32 between lower resilient band 34 and sidewall 16 of cover 14. As such, in some embodiments upper and lower resilient bands 26 and 34 can retain upper and lower rigid frames 12 and 32 respectively within cover 14 during use of lamp shade 10. In such embodiments, upper perimeter 20 of cover 14 can rest on or be supported by upper rigid frame 12, and lower rigid frame 32 can rest on or be supported by lower perimeter 24 of cover 14, such that tension is produced in side wall 16 of cover 14 between upper and lower rigid frames 12 and 32.

Figure 24:
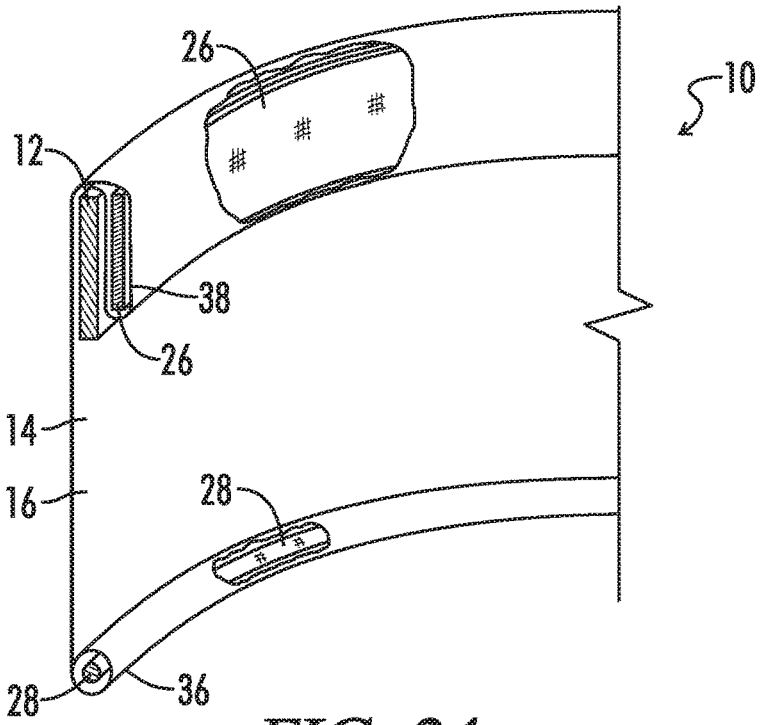
FIG. 24 is a partial cross sectional and cutaway view of another embodiment of a lamp shade of the present disclosure having a weighted member disposed on and fixedly secured to a lower end of the cover.

In other embodiments, as shown in FIG. 24, weight member 28 can be fixedly secured to a lower end 22 of cover 14. Weight member 28 is shown fixedly secured to cover 14 within a lower pocket 36 positioned on lower end 22 of cover 14. Weight member 28 is shown as a metal ring in FIG. 24. In other embodiments, lower pocket 36 of cover 14 can be filled with a suitable substance which can impart weight such as sand, water, etc. In still other embodiments, lamp shade 10 can include multiple weighted members 28 which can be distributed about lower perimeter 24 of cover 14 to provide a distributed downward tension force on cover 14. In still other embodiments, weight member 28 can be weighted beads or other decorative features which can hand down from lower perimeter 24 of cover 14. As such, various types of weight members 28 can be positioned on a lower end 22 of cover 14, such that weight members 28 can generally cause cover 14 to hang down from upper rigid frame 12 in a taut or tensioned fashion. In still other embodiments, cover 14 can be of a significant size and weight such that the weight of cover 14 alone can cause cover 14 to hang down from upper rigid frame 12 in a taut or tensioned fashion.

Figure 3:
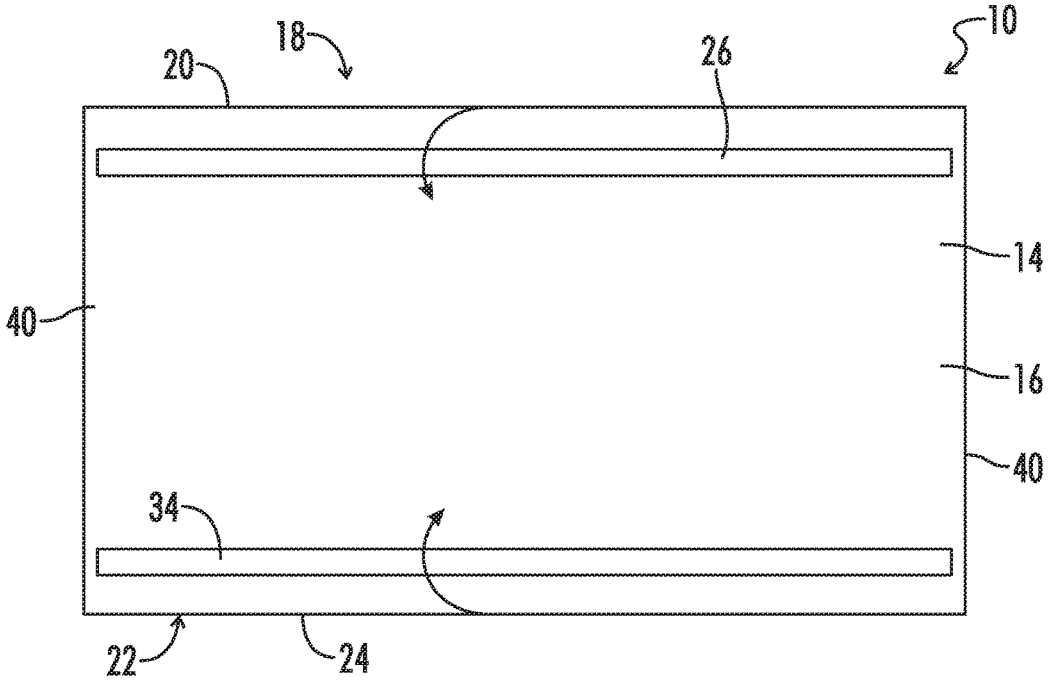
FIG. 3 is a plan view of a cover of the lamp shade of FIG. 1 including resilient bands.
Figure 4:
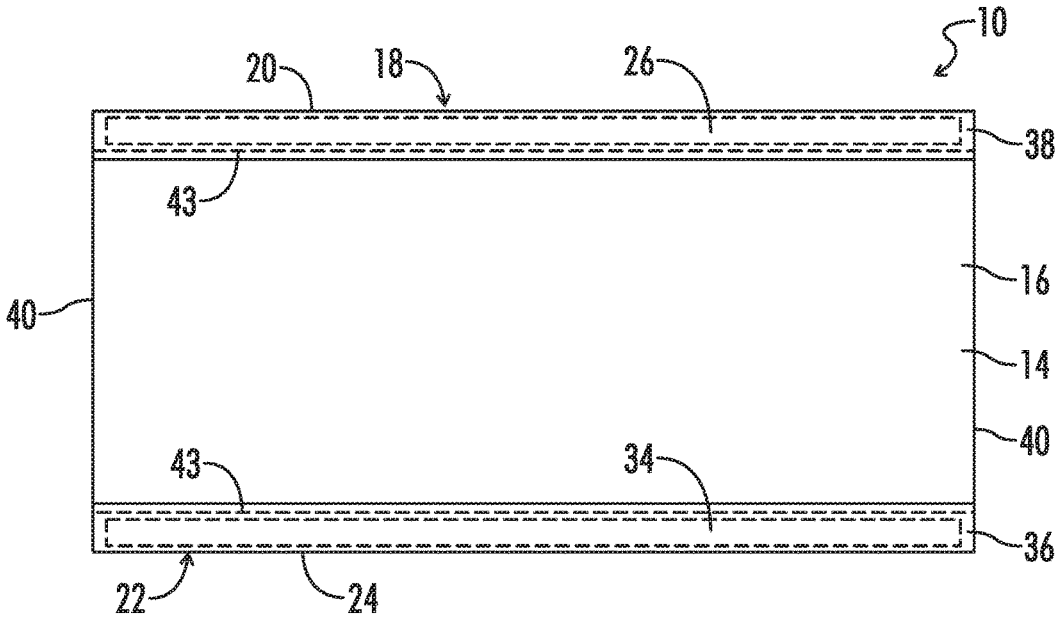
FIG. 4 is a plan view of the cover of FIG. 3 with respective ends of the cover folded to form pockets in the cover, the resilient bands positioned in the pockets of the cover.

Referring now to FIGS. 3 and 4, upper and lower resilient bands 26 and 34 are shown positioned on cover 14. Upper resilient band 26 is positioned at or near upper end 18 of cover 14, and lower resilient band 34 is positioned at or near lower end 22 of cover 14. Upper resilient band 26 can generally extend along the entire upper perimeter 20 of cover 14, and lower resilient band 34 can generally extend along the entire lower perimeter 24 of cover 14. As such, when cover 14 is formed into a closed loop, as shown in FIG. 1, with lateral ends 40 of cover 14 sewn together to form the closed loop, upper resilient bands 26 can generally extend along upper perimeter 20 of cover 14, and lower resilient band 34 can generally extend along lower perimeter 24. In some embodiments, upper and lower resilient bands 26 and 34 can extend along substantially the entire upper and lower perimeters 20 and 24, respectively. As such, upper and lower resilient bands 26 and 34 can form resilient loops in some embodiments. In some embodiments, upper rigid frame 12 can have a substantially circular shape such that upper rigid frame 12 can be an upper rigid circular hoop. Cover 14 hanging down from upper rigid circular hoop 12 can have a circular or cylindrical shape, such that resilient upper and lower bands 26 and 34 on cover 14 can be formed into resilient circular hoops in such embodiments.

Referring again to FIGS. 3 and 4, in some embodiments, upper and lower resilient bands 26 and 34 can be fixedly secured to upper and lower ends 18 and 22 of cover 14 respectively, for instance with a glue or adhesive. In other embodiments, an upper pocket 38 can be formed along upper perimeter 20 of cover 14, and a lower pocket 36 can be formed along lower perimeter 24. Upper resilient band 26 can be positioned in and retained within upper pocket 38, and lower resilient band 34 can be positioned in and retained within lower pocket 36. In some embodiments, a portion of each of upper and lower ends 18 and 20 of cover 14 can be folded onto and fastened, for instance with sewn stitching 43, to side wall 16 of cover 14 to form upper pocket 38 and lower pocket 36 respectively. As shown in FIG. 2, upper pocket 38 can be folded over upper rigid frame 12 to position upper rigid frame 12 between upper resilient band 26 and side wall 16 of cover 14, and lower pocket 36 can be folded under lower rigid frame 32 to position lower rigid frame 32 between lower resilient band 34 and sidewall 16 of cover 14.

Figure 5:
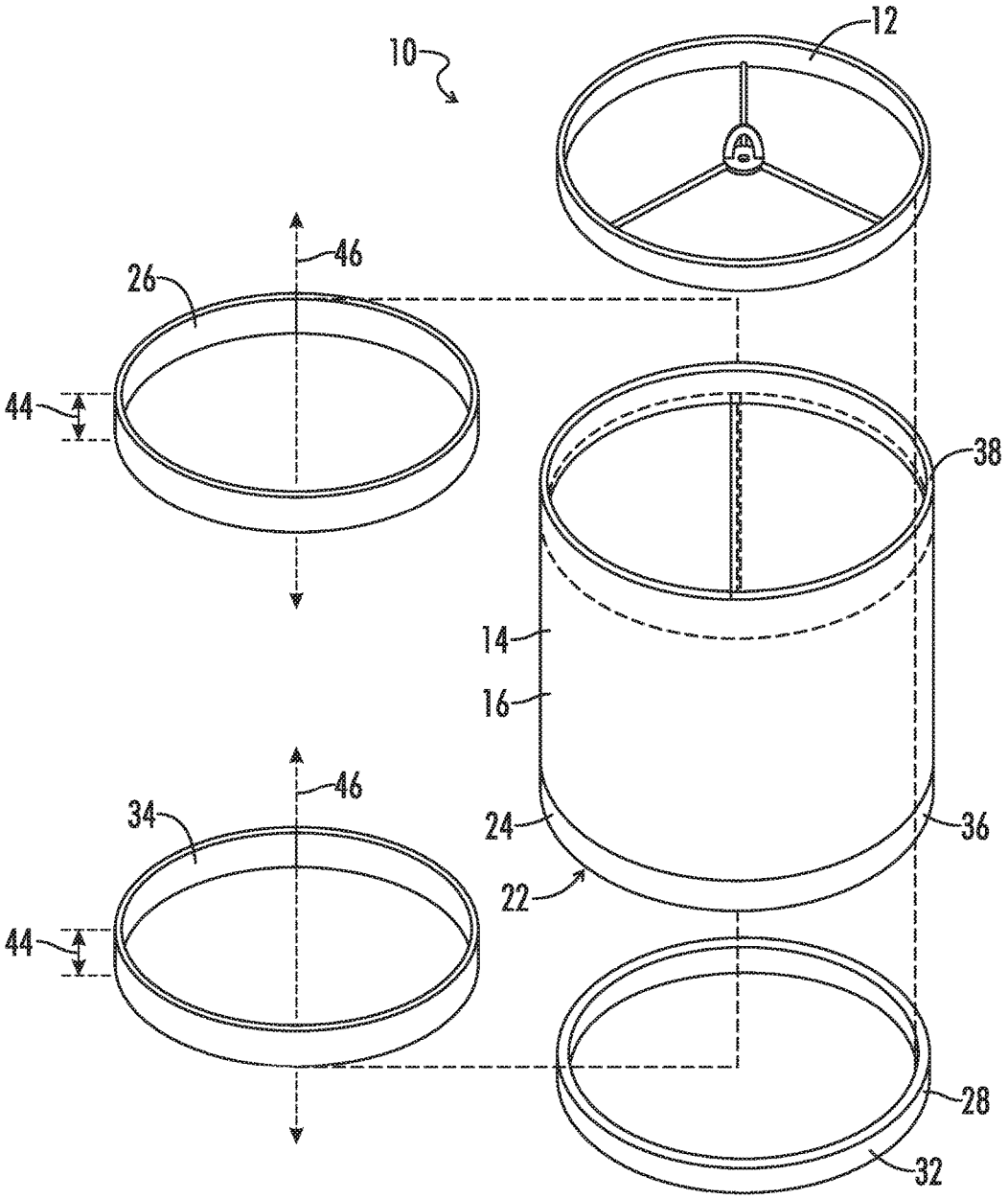
FIG. 5 is an exploded view of the lamp shade of FIG. 1.

FIG. 5 shows an exploded view of lamp shade 10 of FIG. 1 with upper rigid frame 12, lower rigid frame 32, upper resilient band 26 and lower resilient band 34 removed from cover 14. With upper and lower rigid frames 12 and 32 removed from cover 14, cover 14 can be collapsible such that cover 14 can be folded for convenient storage when not in use.

Resilient bands 26 and 34 can be formed into substantially closed loops or hoops on cover 14, as shown in FIG. 5. Resilient bands 26 and 34 can have relatively small thicknesses and can be made of a suitable resilient but flexible material, including but not limited to flexible plastic, metal, composite, rubber, etc. Resilient bands 26 and 34 can be made of materials having a torsional rigidity such that resilient bands 26 and 34 are twistable or can be twisted along a length of bands 26 and 34, but resilient bands 26 and 34 resist a twisting force and once twisted are resiliently biased towards an equilibrium orientation or an untwisted state. Resilient bands 26 and 34 are shown in an equilibrium state in FIG. 5 with widths 44 of resilient bands 26 and 34 oriented substantially parallel to corresponding central axes 46 of resilient bands 26 and 34 along the entire length of the bands 26 and 34 such that the bands 26 and 34 are in an untwisted state. While FIG. 5 shows resilient bands 26 and 34 as flat plates bent or formed into a closed loop, in other embodiments, resilient bands 26 and 34 can be continuous resilient loops. In some embodiments, widths 44 of the resilient bands 26 and 34 can be much greater than the thickness of the resilient bands 26 and 34. In some embodiments, the ratio of widths 44 of the resilient bands 26 and 34 to the thickness of the resilient bands 26 and 34 can be greater than about 10:1. In some embodiments, the ratio of widths 44 of the resilient bands 26 and 34 to the thickness of the resilient bands 26 and 34 can be greater than about 20:1.

Figure 6:
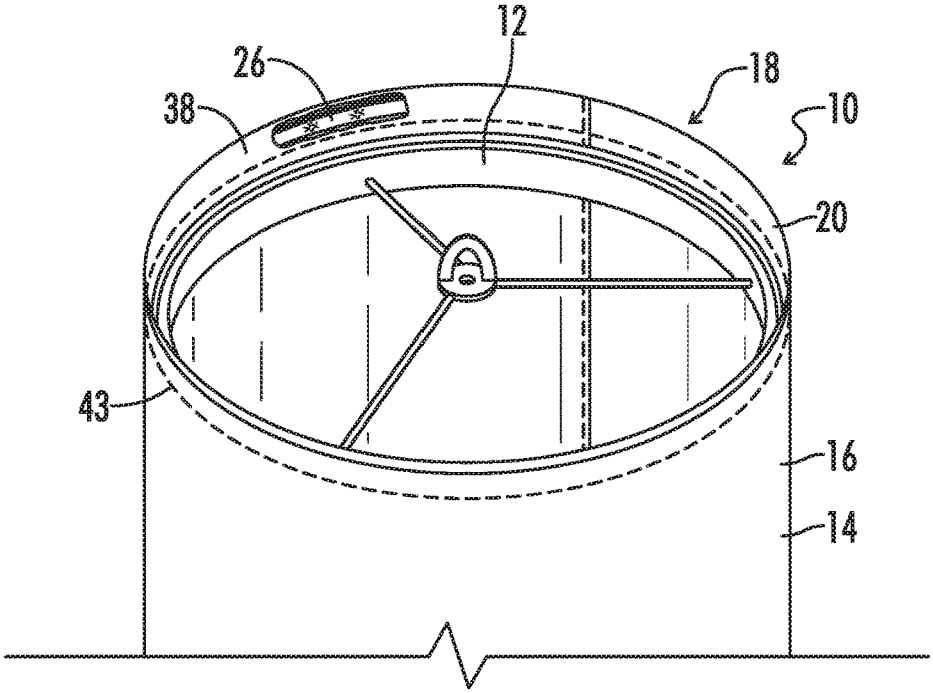
FIG. 6 is a partial perspective view of the lamp shade of FIG. 1 being assembled, an upper rigid frame being positioned at an upper end of the cover.
Figure 7:
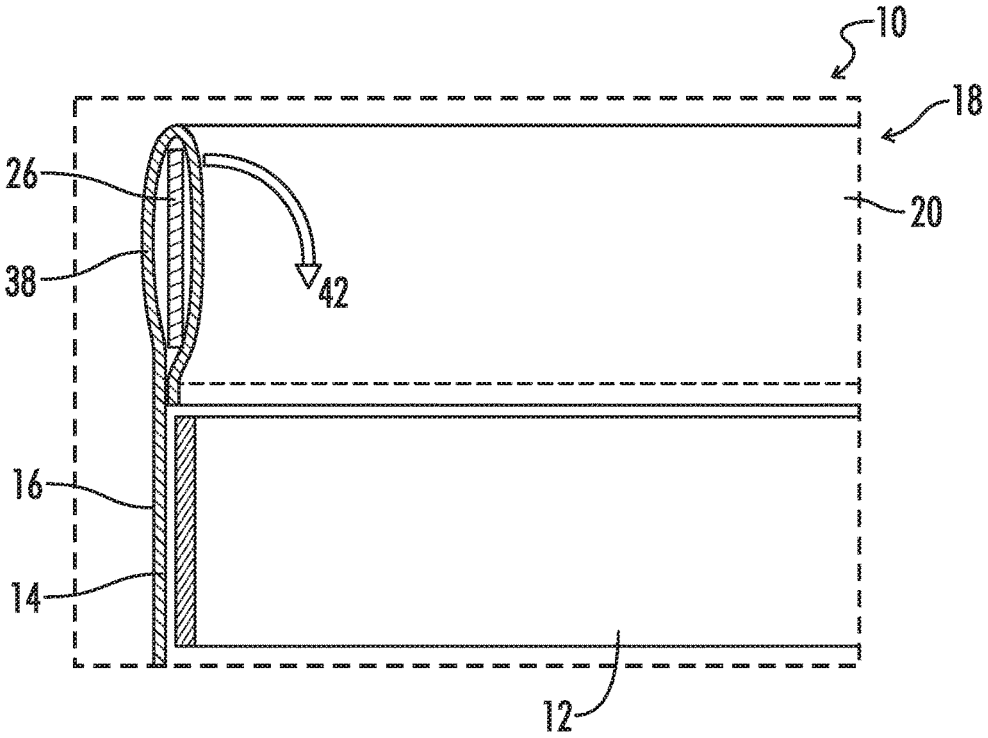
FIG. 7 is a partial cross section view of the cover and the upper rigid frame of the lamp shade of FIG. 6.
Figure 8:
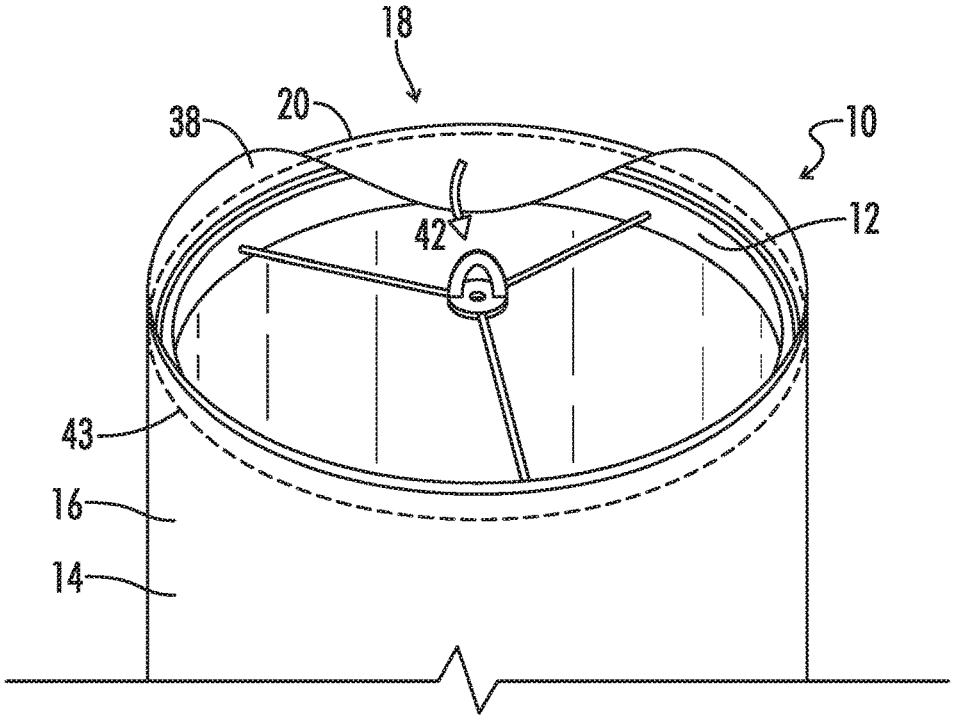
FIG. 8 is a partial perspective view of the cover of FIG. 6 being folded over the upper rigid frame to position the upper rigid frame between an upper resilient band and a sidewall of the cover.
Figure 9:
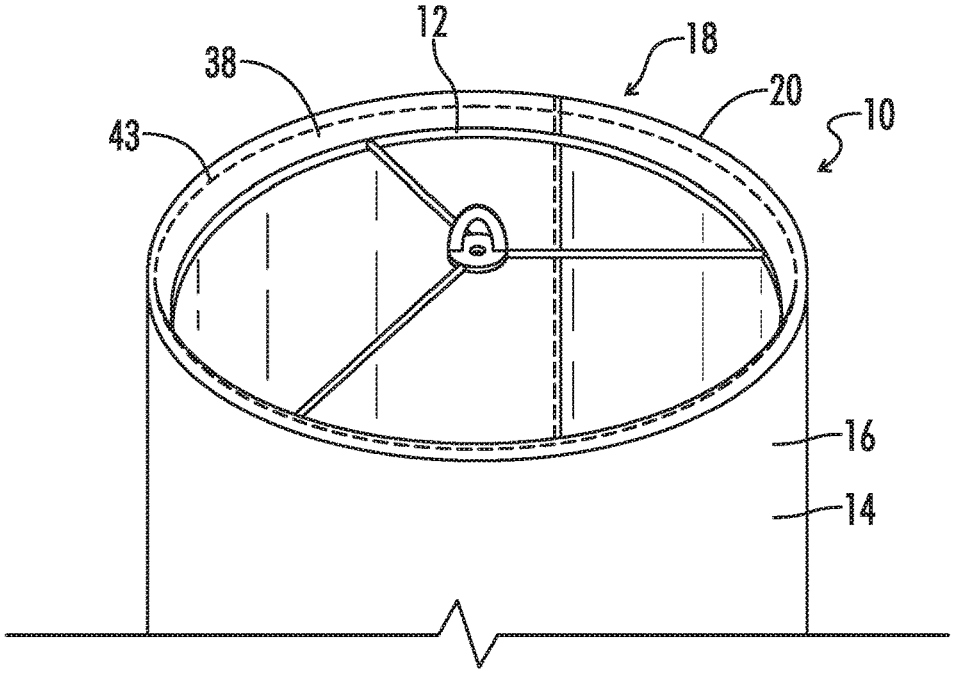
FIG. 9 is a partial perspective view of the cover of FIG. 8 fully folded over the upper rigid frame.
Figure 10:
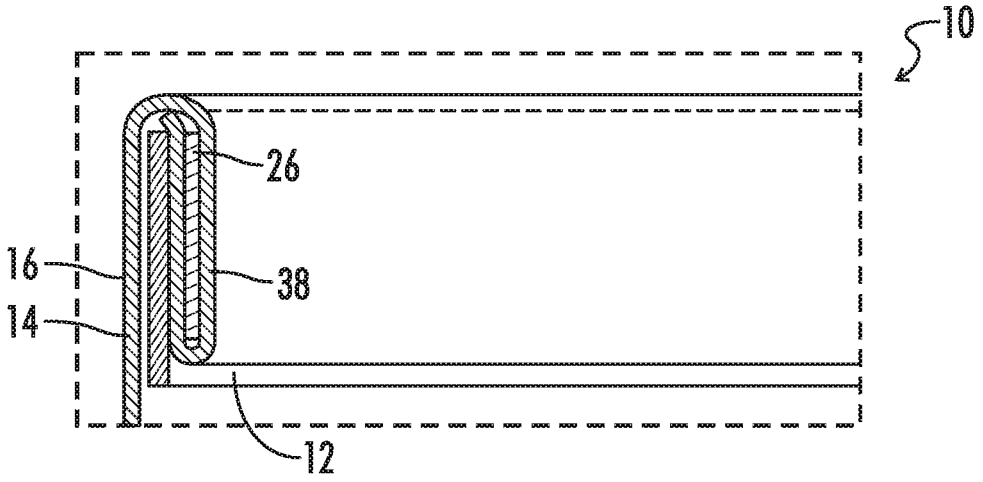
FIG. 10 is a partial cross section view of the cover and the upper rigid frame of FIG. 9.

Assembly of lamp shade 10 of FIG. 1 is further shown in FIGS. 6-15. Upper rigid frame 12 can be positioned at upper end 18 of cover 14, as shown in FIGS. 6-7. Upper rigid frame 12 can be positioned just beneath upper pocket 38 such that upper pocket 38 can be folded over upper rigid frame 12. Upper resilient band 26 is shown in an extended position in FIGS. 6-7 such that upper resilient band 26 extends upwardly with respect to upper rigid frame 12. In the extended position, upper resilient band 26 can also extend upwardly from sidewall 16 of cover 14. With upper resilient band 26 in the extended position, upper rigid frame 12 can be placed within and removed from cover 14. With upper rigid frame 12 positioned at upper end 18 of cover 14, an inward and downward folding torque force 42 can be applied to cover 14, and specifically to upper pocket 38 and upper resilient band 26, to twist and fold upper pocket 38 and upper resilient band 26 over upper rigid frame 12, as shown in FIGS. 8-10. The downward folding torque force 42 can be applied along the upper perimeter 20 of cover 14 until pocket 18 is folded over upper rigid frame 12 along the entire upper perimeter 20 of cover 14. Folding upper pocket 38 and upper resilient band 26 over upper rigid frame 12 can position upper rigid frame 12 between upper resilient band 26 and sidewall 16 of cover 14.

Upper resilient band 26 is shown in a folded position in FIG. 10, with upper resilient band 26 positioned laterally adjacent or internally adjacent to upper rigid frame 12, and upper rigid frame 12 positioned between upper resilient band 26 and sidewall 16 of cover 14. Upper resilient band 26 can generally be in an equilibrium orientation in either the extended position or the folded position. As such, as upper resilient band 26 is initially twisted and folded over upper rigid frame 12 from the extended position shown in FIG. 7 to the folded position shown in FIG. 10, upper resilient band 26 resists the twisting of upper resilient band 26 caused by downward folding torque force 42 such that upper resilient band 26 is biased toward the extended position. As more of upper resilient band 26 is twisted and folded over upper rigid frame 12 to the folded position, an inversion point is passed wherein more of upper resilient band 26 is in the folded position such that upper resilient band 26 becomes biased toward the folded position, and the remainder of upper resilient band moves with relatively little force to the folded position.

Once upper resilient band 26 is in the folded position on upper rigid frame 12, upper resilient band 26 can be resistant to twisting of upper resilient band 26 away from upper rigid frame 12. The resistance to twisting of upper resilient band 26 can retain upper rigid frame 12 in a position between upper resilient band and sidewall 16 of cover 14 until a sufficient upward removal torque force is applied to upper resilient band 26 to twist upper resilient band 26 passed the inversion point wherein upper resilient band 26 is once again biased toward the extended position. Referring again to FIG. 2, lamp shade 10 can be designed such that the force 30*b* applied to the upper perimeter 20 of cover 14 by upper rigid frame 12 to counteract the force of weighted member 28 or lower rigid frame 32 is not large enough to twist upper resilient band 26 past the inversion point such that upper resilient band 26 remains in the folded position and cover 14 is retained on upper rigid frame 12 during use of lamp shade 10 when cover 14 is tensioned.

In those embodiments having a weight member 28 fixedly secured to a lower end 22 of cover 14, as shown in FIG. 24, once upper pocket 38 and upper resilient band 26 are twisted and folded over upper rigid frame 12, lamp shade 10 can be suspended from a light fixture via upper rigid frame 12. Cover 14 is tensioned between upper rigid frame 12 and weight member 28 to complete the assembly.

Figure 11:
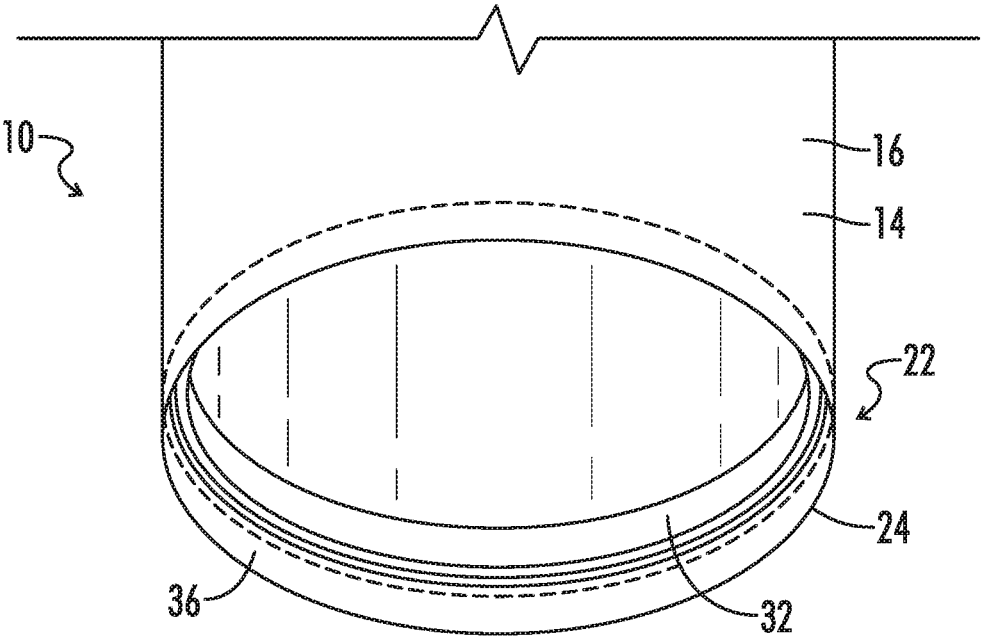
FIG. 11 is a partial bottom perspective view of the lamp shade of FIG. 10 with a lower rigid frame positioned at a lower end of the cover.
Figure 12:
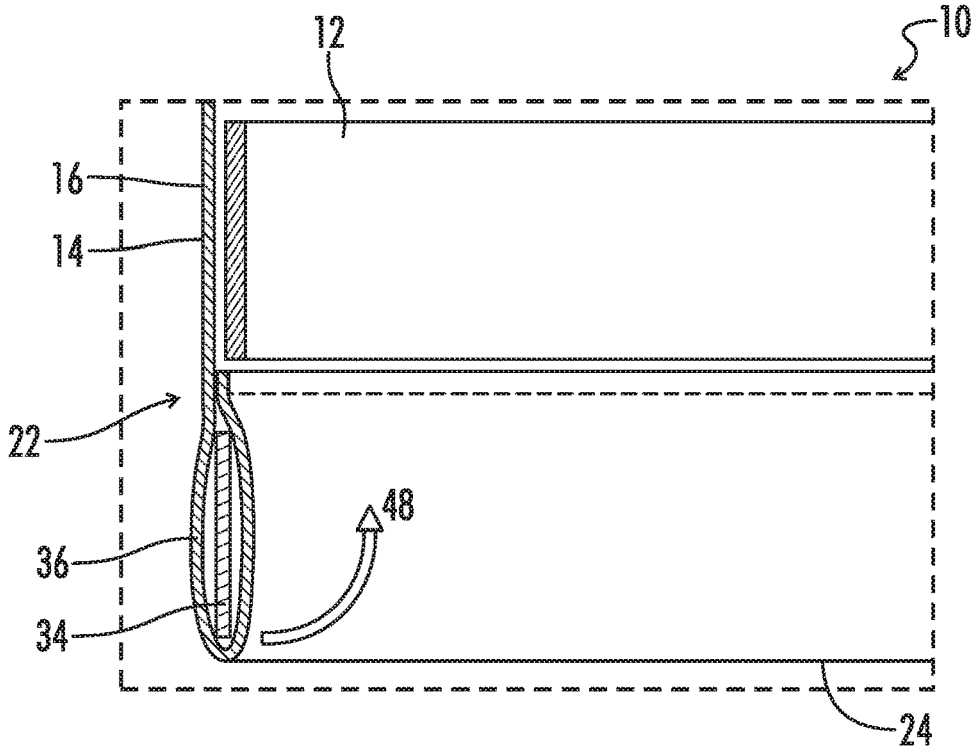
FIG. 12 is a partial cross sectional view of the cover and the lower rigid frame of FIG. 11.
Figure 13:
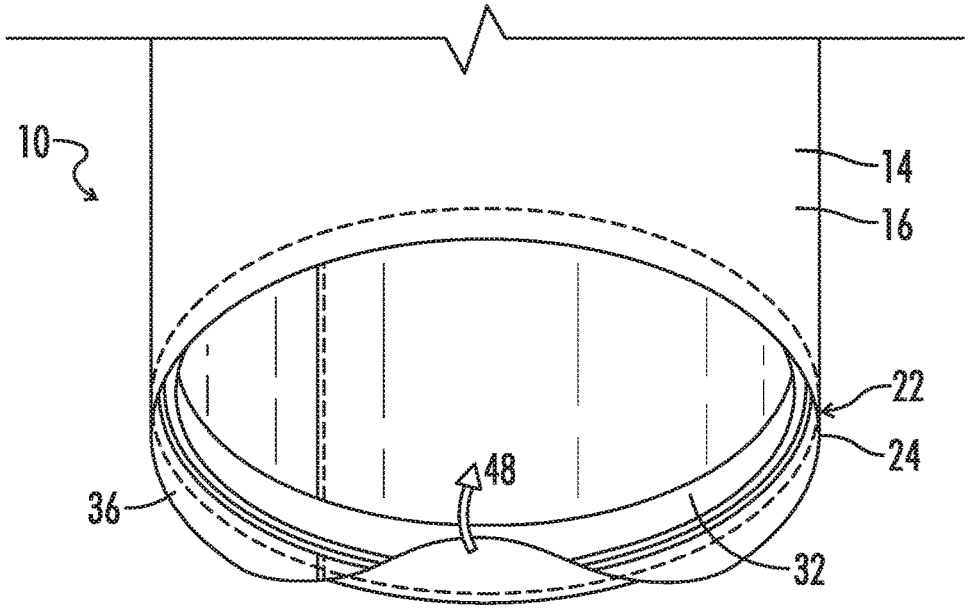
FIG. 13 is a partial bottom perspective view of the cover of FIG. 11 being folded under the lower rigid frame.
Figure 14:
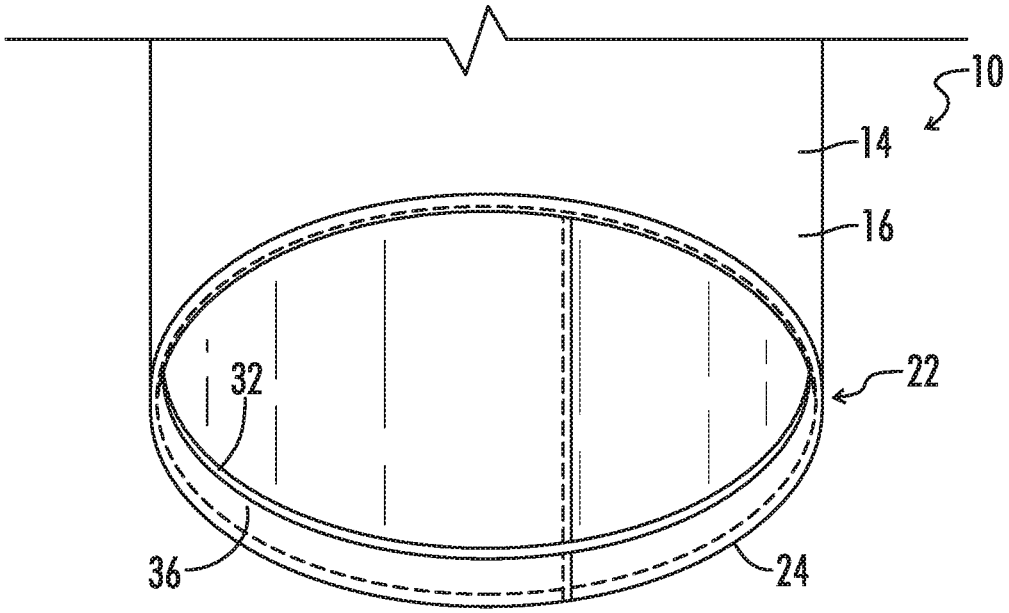
FIG. 14 is a bottom perspective view of the cover of FIG. 13 fully folded under the lower rigid frame.
Figure 15:
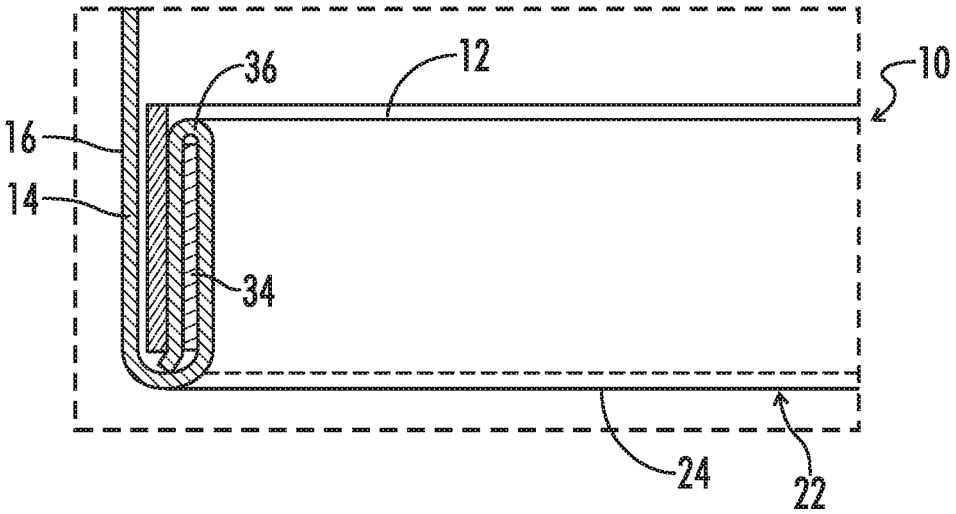
FIG. 15 is a partial cross sectional view of the cover and lower rigid frame of FIG. 14.

In those embodiments including a lower rigid frame 32, lower rigid frame 32 can then be positioned at lower end 22 of cover 14, as shown in FIGS. 11-12. Lower rigid frame 32 can be positioned just above lower pocket 36 and lower resilient band 34 such that lower pocket 36 and lower resilient band 34 can be folded under lower rigid frame 32. Lower resilient band 34 is shown in an extended position in FIGS. 11-12 wherein lower resilient band 34 extends downwardly with respect to lower rigid frame 32 and downwardly from sidewall 16 of cover 14. An inward and upward folding torque force 48 can be applied to lower perimeter 24 of cover 14 and specifically to lower pocket 36 and lower resilient band 34 to twist and fold lower pocket 36 and lower resilient band 34 under lower rigid frame 32 until lower resilient band 34 is twisted past an inversion point and is biased toward a folded position as shown in FIGS. 13-15.

Once lower resilient band 34 is in the folded position, lower resilient band 34 can be resistant to twisting away from lower rigid frame 32 such that lower rigid frame 32 is retained in a position between lower resilient band 34 and sidewall 16 of cover 14. Referring again to FIG. 2, lower resilient band 34 and lower rigid frame 32 can be designed such that the force 30*a* applied on lower perimeter 24 of cover 14 by the weight of lower rigid frame 32 would not twist lower resilient band 34 past the inversion point. As such, lower resilient band 34 is retained in the folded position and lower rigid frame 12 is retained between lower resilient band 34 and sidewall 16 of cover 14 when lamp shade 10 is in use.

Once upper pocket 38 and upper resilient band 26 are folded over upper rigid frame 12 and lower pocket 36 and lower resilient band 34 are folded under lower rigid frame 12, lamp shade 10 can be suspended from a light fixture via upper rigid frame 12 to tension cover 14 between upper and lower rigid frames 12 and 32 to complete the assembly.

Figure 16:
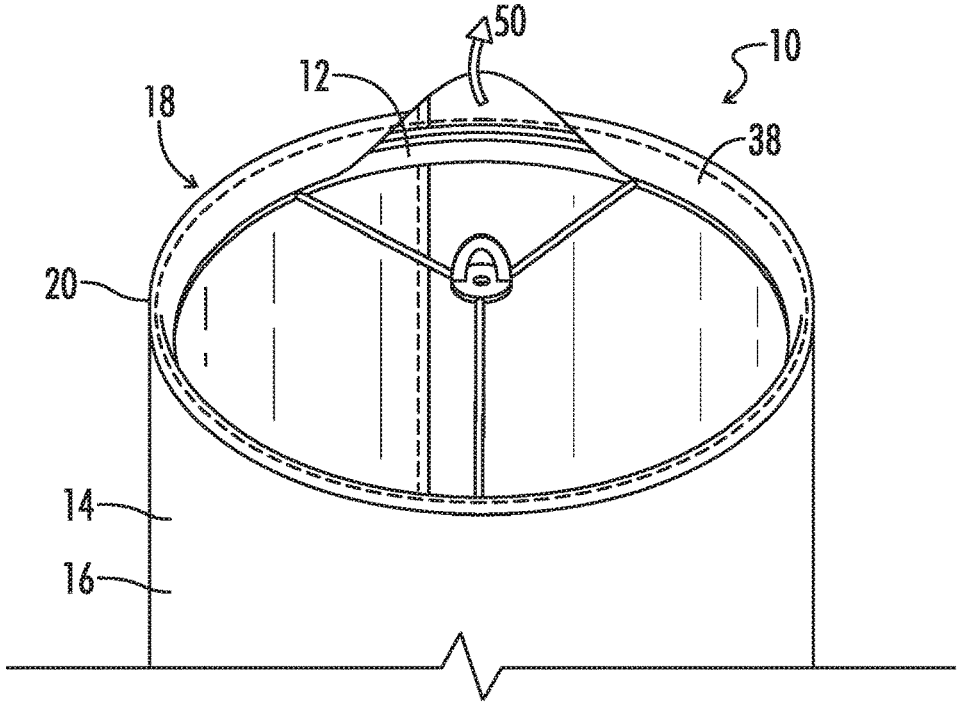
FIG. 16 is a partial top perspective view of the lamp shade of FIG. 9 showing the cover being twisted away from the upper rigid frame to remove the cover from the upper rigid frame.

To disassemble lamp shade 10, and/or interchange or replace cover 14 of lamp shade 10 with a new cover, an upward removal torque force 50 can be applied to upper pocket 38 and upper resilient band 26, as shown in FIG. 16. Upward removal torque force 50 can twist upper resilient band 26 past the inversion point, such that upper resilient band 26 returns to the extended position shown in FIG. 7, and cover 14 can be removed from upper rigid frame 12. As such, upper resilient band 26 is twistable from the folded position to the extended position wherein the upper resilient band 26 extends upwardly from sidewall 16 of cover 14 such that cover 14 is removable from upper rigid frame 12.

Figure 17:
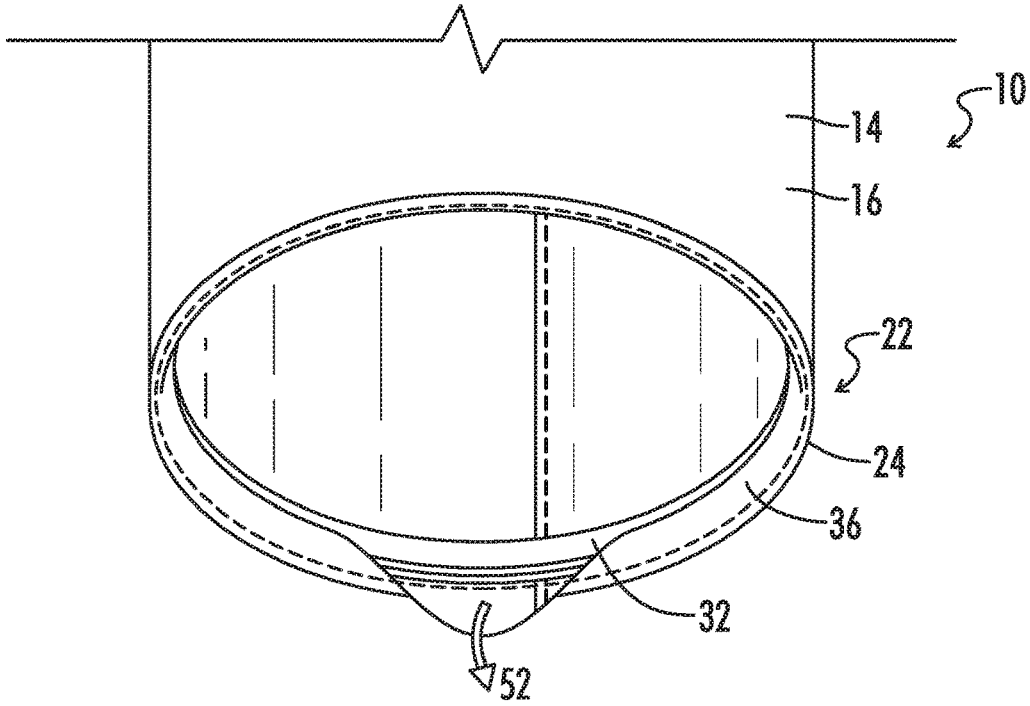
FIG. 17 is a partial bottom perspective view of the lamp shade of FIG. 14 showing the cover being twisted away from the lower rigid frame to remove the cover from the lower rigid frame.

When lamp shade 10 includes a lower rigid frame 32 retained between a lower resilient band 34 and cover 14, a downward removal torque force 52 can be applied to lower pocket 36 and lower resilient band 34, as shown in FIG. 17. Downward removal torque force 52 can twist lower resilient band 34 past the inversion point and return the lower resilient band 34 to the extended position shown in FIG. 12, wherein the lower resilient band 34 extends downwardly from sidewall 16 of cover 14. With lower resilient band 34 in the extended position, cover 14 can be removed from lower rigid frame 32. A new cover can readily be assembled onto the upper rigid frame and/or the lower rigid frame following the method described above.

The lamp shade of the present disclosure can thus allow different covers to be conveniently and quickly interchanged with one another on the upper rigid frame, and as necessary on the lower rigid frame. The upper resilient band positioned on each cover can be readily twisted over the upper rigid frame to the folded position to secure the cover to the upper rigid frame and quickly assemble the lamp shade. The upper resilient band can subsequently be readily and quickly twisted to return the upper resilient band to the extended position to remove the cover from the upper rigid frame and switch out covers for the lamp shade. Being able to quickly and conveniently switch out covers on a lamp shade can allow a user to readily customize the design of a lighting fixture such as lamp, for instance when the user wants a different lighting profile, or when the user desires to cater the design of the lamp to a particular event, including but not limited to, a party, sporting event, or holiday.

Such a lamp shade can provide a substantial benefit over conventional lamp shades where covers are fixedly secured or sewn onto or around a frame for the lamp shade. To switch out covers for conventional lamp shade, the entire lamp shade had to be replaced, which meant that mechanical fasteners connecting the frame of the lamp shade to a lighting assembly had to be removed to take the lamp shade off of the lighting assembly. A new lamp shade then had to be mounted to the lighting assembly using the mechanical fasteners.

Referring again to FIG. 2, the design of lamp shade 10 of the present disclosure can allow upper rigid frame 12 to remain mounted or connected to a lighting assembly while the cover 14 can be quickly and conveniently removed and replaced on the upper rigid frame 12, which can help reduce the time and difficulty associated with replacing covers in conventional lamp shades.

In some embodiments, as shown in FIG. 1, upper rigid frame 12 can include a central hub 54 having a central aperture 56 defined in central hub 54 and a suspension eyelet 58 extending upwardly from central hub 54. Two or more support arms 60 can extend radially outward from central hub 54. Upper rigid frame 12 can include an outer frame 62. Support arms 60 can each extend between central hub 54 and outer frame 62. Support arms 60 can be distributed evenly about central hub 54 to provide distributed support to outer frame 62. Cover 14 and upper resilient band 26 can be folded over outer frame 62. In some embodiments, central hub 54 can include only a central aperture 56, and in other embodiments, central hub 54 can include only a suspension eyelet 58.

Figure 18:
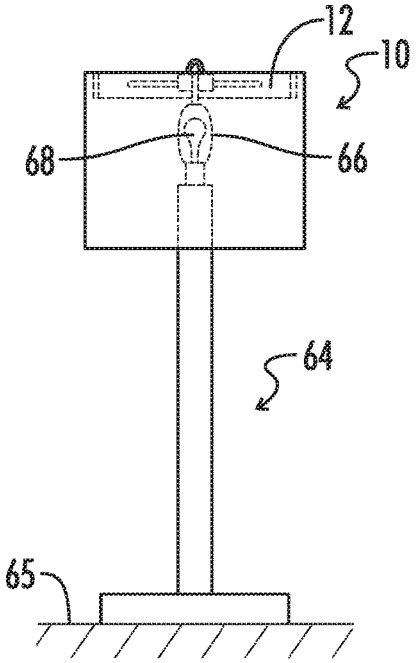
FIG. 18 is a side view of the lamp shade of FIG. 1 being used with a standing lamp style lighting assembly.

Lamp shade of FIG. 1 is shown in FIG. 18 being used with a conventional standing lamp style lighting fixture 64 that can rest on a floor 65. Lighting assemblies and fixtures can include a lighting assembly frame 66 surrounding a light source 68, the lighting assembly frame 66 typically including a bolt extending upwardly from the frame. The bolt of the lighting assembly frame 66 can be inserted through the central aperture 56 of the upper rigid frame 12 and a cap can be screwed onto the bolt of the lighting assembly frame 66 to secure upper rigid frame 12 to the standing lamp style lighting assembly 64.

Figure 19:
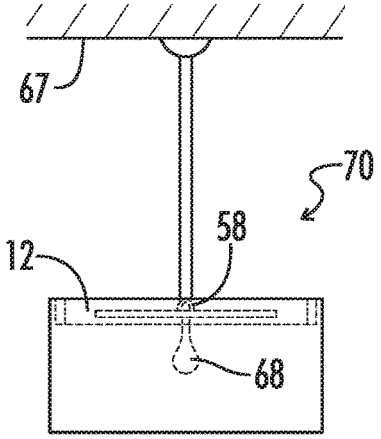
FIG. 19 is a side view of the lamp shade of FIG. 1 being used with a hanging or suspension style lighting assembly.

In other embodiments, as shown in FIG. 19, lamp shade 10 of FIG. 1 can be used with a conventional suspension style lighting fixture 70 which can be suspended from a ceiling 67. The suspension lighting fixture 70 can be hooked to suspension eyelet 58 of upper rigid frame 12 to suspend lamp shade 10 from lighting fixture 70. In some embodiments, hardware associated with light source 68 of lighting fixture 70 can be mechanically secured to central hub 54 via central aperture 56.

Figure 20:
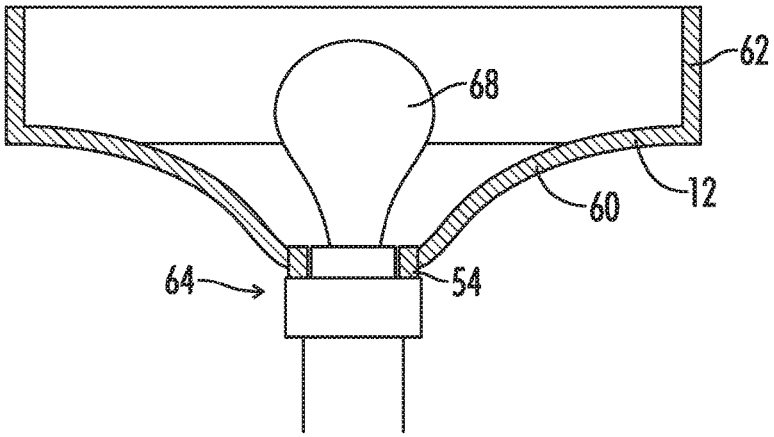
FIG. 20 is a partial cross sectional view of another embodiment of a lamp shade of the present disclosure having an upper rigid frame with downwardly angled radial support arms.

In still other embodiments, as shown in FIG. 20, central hub 54 of upper rigid frame 12 can rest on a lighting fixture such as a standing lamp style lighting fixture 64 or suspension style lighting assembly wherein light source 68 extends upwardly from central hub 54. In such embodiments, central hub 54 can be oriented below outer frame 62, and support arms 60 can extend in a downward direction from outer frame 62 to central hub 54 so that light source 68 can be retained within cover 14 when cover 14 is secured to outer frame 62.

Figure 21:
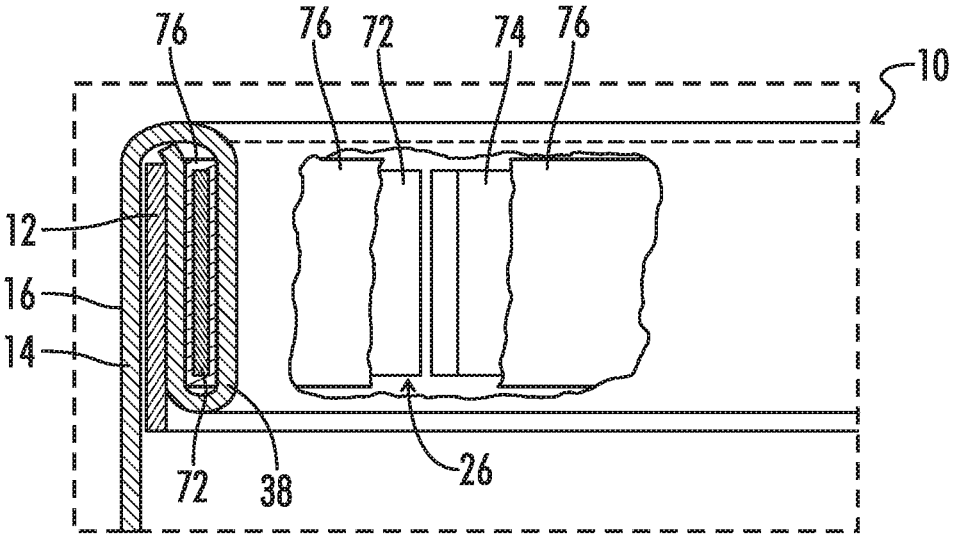
FIG. 21 is a partial cross sectional view and cutaway view of another embodiment of a lamp shade of the present disclosure wherein an upper resilient band of the lamp shade includes a first band member, a second band member, and a band wrap extending around and securing the first and second band members together in an end to end fashion.
Figure 23:
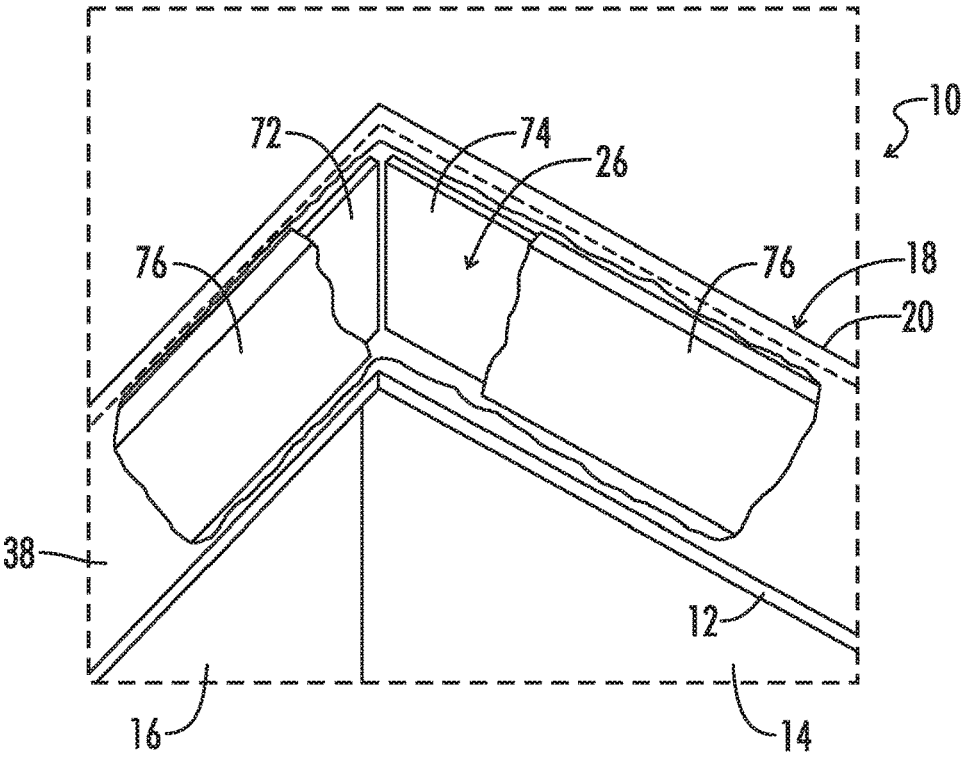
FIG. 23 is a partial detailed cutaway view of the lamp shade of FIG. 22.

In FIG. 5, upper resilient band 26 is shown as a single band bent to form a closed loop. In other embodiments, as shown in FIGS. 21 and 23, upper resilient band 26 can include a first band member 72, a second band member 74, and a band wrap 76 extending around and joining first band member 72 to second band member 74 in an end to end fashion. Band wrap 76 in some embodiments can be a sheath, first and second band members 72 and 74 received within the sheath. In other embodiments, band wrap 76 can be a tape adhesive wound around first and second band members 72 and 74 to form upper resilient band 26. In other embodiments, upper resilient band 26 can include numerous additional band members encased in a band wrap 76. Small breaks or gaps can be defined between successive band members 72 and 74 within band wrap 76. Having small gaps between successive band members 72 and 74 can help allow upper resilient band 26 to be bent at sharper angles than could be achieved with a single band piece. Upper resilient band 26 can be bent at angles greater than or equal to about ninety degrees at the joint between successive band members 72 and 74, as shown in FIG. 23. However, band wrap 76 being disposed around band members 72 and 74 to join band members 72 and 74 together can help maintain the torsional rigidity of the overall upper resilient band 26 necessary for upper resilient band 26 to resist twisting from an equilibrium orientation in order to retain cover 14 on upper rigid frame 12 when upper resilient band 26 is folded over upper rigid frame 12.

Figure 22:
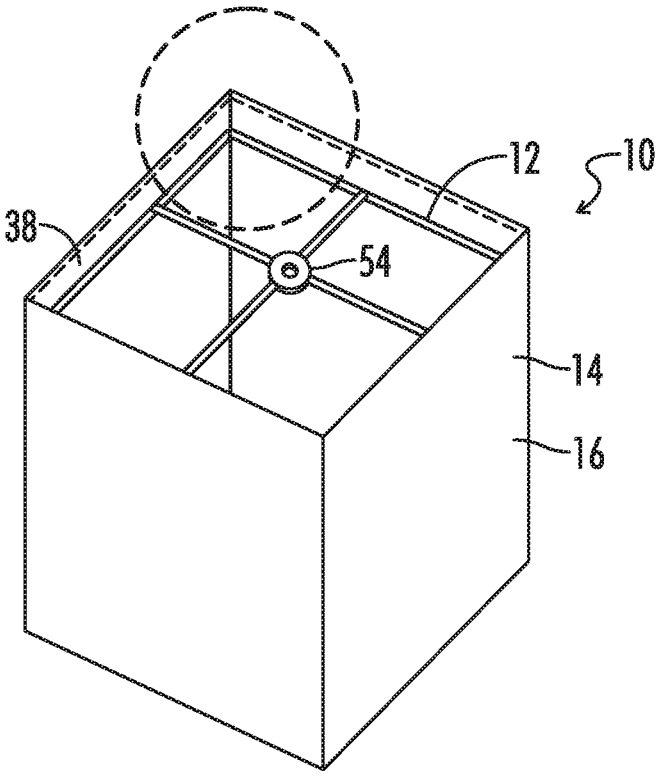
FIG. 22 is a perspective view of another embodiment of a lamp shade of the present disclosure wherein the upper rigid frame and the cover have a rectangular shape.

Having an upper resilient band 26 having multiple band members encased in a band wrap 76 can provide increased bending flexibility to upper resilient band 26 such that cover 14 and upper resilient band 26 can be bent and customized as needed to contour various lamp shade shapes. While lamp shade 10 is shown having a circular or cylindrical shape in FIG. 1 upper rigid frame 12 could be made in a variety of shapes and sizes, including but not limited to, rectangular (as shown in FIGS. 22 and 23), oval, elliptical, triangular, hexagonal, trapezoidal, star patterned, etc. Having increased flexibility in the bending of upper resilient band 26 can allow cover 14 and upper resilient band 26 to be formed and shaped to contour various desired shapes for upper rigid frame 12 while still maintaining the twisting resistance needed to retain cover 14 on the upper rigid frame 12. In some embodiments, lower resilient band 34 can also include multiple band members and a band wrap joining the band members in an end to end fashion.

Another aspect of the present disclosure is a method of assembling a lamp shade including the steps of providing a cover having a sidewall, an upper end having an upper perimeter, and an upper resilient band extending along the upper perimeter of the cover; positioning an upper rigid frame at the upper end of the cover; and removably folding the cover over the upper rigid frame such that the upper rigid frame is positioned between the upper resilient band and the sidewall of the cover, the upper resilient band resistant to twisting away from the upper rigid frame to retain the upper rigid frame between the upper resilient band and the cover. The folding step can include applying a torque force to the upper resilient band to twist and fold the upper resilient band over the upper rigid frame.

The method can further include positioning a weight member on a lower end of the cover and suspending the lamp shade from the upper rigid frame such that the upper rigid frame supports the cover and the weight member produces tension in the sidewall of the cover. The method can further include the step of twisting the upper resilient band away from the upper rigid frame to remove the cover from the upper rigid frame.

Thus, although there have been described particular embodiments of the present invention of a new and useful LAMP SHADE FOR A LIGHTING FIXTURE AND METHOD OF ASSEMBLY, it is not intended that such references to particular embodiments be construed as limitations upon the scope of this invention.

What is claimed is:

1. A lamp shade comprising:

an upper rigid frame;

an interchangeable cover disposed on the upper rigid frame, the interchangeable cover having a sidewall and an upper end having an upper perimeter;

an upper resilient band positioned on the cover and extending along the upper perimeter of the cover, the upper rigid frame positioned between the upper resilient band and the sidewall of the cover, the upper resilient band resistant to twisting away from the upper rigid frame to retain the upper rigid frame between the upper resilient band and the sidewall of the cover; and an upper pocket formed along the upper perimeter of the cover, the upper resilient band disposed in the upper pocket.

2. The lamp shade of claim 1, wherein the interchangeable cover includes a lower end having a lower perimeter, and the lamp shade further comprises a weight member supported on the lower end of the interchangeable cover to tension the sidewall of the cover.

3. The lamp shade of claim 2, wherein:

the weight member is a lower rigid frame;

the lamp shade further comprises a lower resilient band positioned on and extending along the lower perimeter of the cover, the lower rigid frame positioned between the lower resilient band and the sidewall of the cover, the lower resilient band resistant to twisting away from the lower rigid frame to retain the lower rigid frame between the lower resilient band and the sidewall of the cover.

4. The lamp shade of claim 1, wherein a portion of the upper end of the cover is folded and fastened to the sidewall of the cover to form the upper pocket along the upper perimeter of the cover.

5. The lamp shade of claim 4, wherein the upper pocket is folded over the upper rigid frame to position the upper rigid frame between the upper resilient band and the sidewall of the cover.

6. The lamp shade of claim 1, wherein the upper resilient band extends along the entire upper perimeter of the cover.

7. The lamp shade of claim 1, wherein the upper resilient band is twistable from a folded position laterally adjacent the upper rigid frame to an extended position wherein the upper resilient band extends upwardly from the sidewall of the cover.

8. The lamp shade of claim 7, wherein the upper resilient band is in an equilibrium orientation when the upper resilient band is in either the folded position or the extended position.

9. The lamp shade of claim 8, wherein the upper band has a torsional rigidity such that as the upper resilient band is twisted away from the equilibrium orientation, the upper resilient band is biased to return to the equilibrium orientation.

10. The lamp shade of claim 7, wherein the cover is removable from the upper rigid frame when the upper resilient band is in the extended position.

11. The lamp shade of claim 1, wherein the upper rigid frame includes:

a central hub including a central aperture defined through the central hub and a suspension eyelet extending upwardly from the central hub;

two or more support arms extending radially outward from the central hub; and an outer frame, each of the radial support arms extending between the central hub and the outer frame.

12. The lamp shade of claim 1, wherein the upper resilient band further comprises:

a first band member;

a second band member; and a band wrap extending around and joining the first band member and the second band member in an end to end fashion.

13. The lamp shade of claim 1, wherein:

the upper rigid frame further comprises a rigid circular hoop; and the upper resilient band forms a resilient circular hoop.

* * * * *